United States Patent [19]

Ludwig et al.

[11] 3,980,531

[45] Sept. 14, 1976

[54] BATH AND PROCESS FOR THE ELECTROLYTIC SEPARATION OF RARE METAL ALLOYS

[75] Inventors: Rolf Ludwig; Josif Ćuljković, both of Berlin, Germany

[73] Assignee: Schering Aktiengesellschaft, Berlin and Bergkamen, Germany

[22] Filed: July 3, 1975

[21] Appl. No.: 592,819

[30] Foreign Application Priority Data

Sept. 20, 1974 Germany ..... 2445538

[52] U.S. Cl. ..... 204/43 R; 204/43 N; 204/43 G; 204/43 T; 204/43 Z; 204/43 S; 204/44

[51] Int. Cl.[2] ..... C25D 3/62; C25D 3/64; C25D 3/56; C25D 3/50

[58] Field of Search ..... 204/43 N, 43 G, 43 R, 204/43 T, 43 Z, 43 S, 44

[56] References Cited

OTHER PUBLICATIONS

"Trans. The Electrochem. Soc." vol. 74, 1938, pp. 237–239.

*Primary Examiner*—R. L. Andrews
*Attorney, Agent, or Firm*—Joseph F. Padlon

[57] ABSTRACT

A cyanide-free bath for the galvanic separation of rare-metal alloys in which a rare metal is present in the form of a thiosulphate compound. The rare metal may be gold and/or silver, and/or palladium. The rare metal is present in concentrations of 0.01 to 70 g/liter.

9 Claims, No Drawings

BATH AND PROCESS FOR THE ELECTROLYTIC SEPARATION OF RARE METAL ALLOYS

BACKGROUND OF THE INVENTION

The present invention relates to a cyanide-free bath for the galvanic separation of rare-metal alloys.

Cyanidic baths for the galvanic separation of rare metals such as gold, silver or palladium and their mutual alloys or their alloys with other metals such as copper, nickel, cobalt, cadmium, tin, zinc or arsenic are already known in the art. Their disadvantage is the extraordinary toxicity of the cyanides contained therein, which makes them objectionable from the viewpoints of occupational hygiene and water treatment. It is further known that such baths as luster additives contain sulphur compounds such as thiourea, alkali thiocyanates or alkali thiosulphates (German Disclosure Document Nos. 22 33 783, 19 23 786, 20 10 725).

These electrolytes, however, also contain cyanide and have the further disadvantage of acting neither in a luster forming nor luster preserving manner and also not acting in a smoothing manner.

Finally, there is known in the art, cyanide-free alkaline gold baths containing gold as sulphite and luster-intensifying additives (German Disclosure Document No. 16 21 180). Such gold sulphite compounds, however, have little stability, and even with an extremely high excess of free sulphite ions, after standing for some time in solution, will form elementary gold which will make the solution useless.

It is, therefore, an object of the present invention to provide a stable bath which avoids the disadvantages of the known baths and makes possible the cyanide-free galvanic separation of alloys of the rare metals gold, silver and palladium both with one another and with the metals copper, cadmium, arsenic, antimony, nickel, cobalt, lead, zinc and tin with good technical properties.

SUMMARY OF THE INVENTION

The objects of the present invention are achieved by providing a bath which contains a rare metal in the form of a thiosulphate compound.

Such thiosulphate compounds are compounds of varying composition with gold, silver or palladium as central atom and at least one thiosulphate bond.

These thiosulphate compounds are known and can be produced by known methods.

For example, $Na_3$ [Ag $(S_2O_3)_2$]. 2 $H_2O$ can be produced by mixing an ammonia silvernitrate solution with sodium thiosulphate and precipitating the resulting compound with potassium nitrate and alcohol.

Sodium dithiosulphate aurate (I) ($NA_3$ [$Au(S_2O_3)_2$]. 2 $H_2O$) can be obtained, for example, by reduction of sodium tetrachloro aurate (III) (Na [$AuCl_4$] ) with thiosulphate and precipitation of the formed compound with alcohol.

A palladium thiosulphate compound $K_2$ [$Pd(S_2O_3)_2$] is precipitated if an aqueous solution of potassium tetrachloro palladate (II) ($K_2$ $PdCl_4$ ) is mixed with a stoichiometric quantity of thiosulphate and is dissolved in its excess with a cherry-red color.

The thiosulphate compound $Na_3$ [$Ag(S_2O_3)_2$] , $Na_4$ [$Ag_2(S_2O_3)_3$] , $Na_4$ [$Au_2(S_2O_3)_3$] , and $Na_4$ [$Pd(S_2O_3)_3$] can be produced in a similar manner. In addition, the bath may, to advantage, contain at least one of the alloying metals copper, cadmium, cobalt, nickel, arsenic, antimony, manganese, indium, zinc, lead or tin. It may also be advantageously in the form of a water-soluble compound, e.g., as sulphate, chloride, nitrate, acetate or citrate or as a compound such as its amine group, chelate or even as thiosulphate group.

DESCRIPTION OF THE PREFERRED EMBODIMENTS

The rare metals gold, silver and palladium may be present in concentrations of 0.01 g/liter to 70 g/liter and the alloying metals copper, nickel, cobalt, manganese, zinc, cadmium, indium, tin, lead, antimony and arsenic may be present in concentrations of 0.001 g to 100 g/liter in the bath.

The thiosulphate compounds of the above metals, with a thiosulphate excess (molar ratio metal/thiosulphate 1 : 2 or greater) as well soluble in the bath.

By thiosulphates are meant ammonium and/or alkali salts, preferably the sodium or potassium salts of the thiosulphuric acid or their adducts with basic compounds, such as amines or polyamines. The concentration of thiosulphate in a solution is at least 1 g/liter, preferably 20 g to 500 g/liter.

When using silver or copper anodes, it is advantageous to work with high thiosulphate concentrations to guaranty optimum anodic solubility. When working with insoluble anodes, one adds, if desired, reduction agents such as nitrites, oxalates or sulphites, preferably in the form of its alkali salts such as sodium or potassium salts.

As further additives, the bath may also contain the usual components. These are, e.g., conductive salts such as, e.g., ammonium or alkali salts of inorganic or slightly organic acids, e.g., sulphuric acid, sulphurous acid, carbonic acid, boric acid, sulfamic acid, acetuc acid, citric acid and others.

In addition, the bath may contain substances regulating the pH value, expediently the usual organic and/or inorganic buffer mixtures, such as disodium phosphate, alkali carbonate, alkali borate, alkali acetate, alkali citrate, alkali metabisulphite or a mixture of boric acid and ethylene glycol.

The pH value of the baths may be from 4 to 13, preferably from 5 to 11. It is convenient to operate them at temperatures of about 10° to 80°C, preferably from 20° to 55°C, using current densities of about 0.1 to 5 Amp/dm$^2$.

With the bath according to the present invention, there can be deposited binary, ternary and quaternary rare metal alloys, which are distinguished by excellent quality and is superior to the coatings deposited from known baths.

In accordance with the invention, one can produce binary rare-metal alloys of special technical interest, e.g., a 12 to 14 karat gold-silver alloy, which looks like silver and is tarnish-proof. It is useful in electrical engineering and for decorative purposes. A binary silver-nickel alloy with nickel contents up to 1 percent by weight is extremely hard (micro Vickers hardness $HV_{010} = 310$ kp/mm$^2$) and excellently suited for electrical contacts.

Among the ternary alloys produced in accordance with the present invention are gold-copper-cadmium alloys with gold contents of about 8 to 23 karat. Depending on the gold content, one may obtain colors from yellow via rose to red, with the alloys above about 15 karat being surprisingly tarnish resistant. Excellent quality is shown by 16 to 20 karat alloys which have hardnesses from 320 to 450 Kp/mm². They play an important part in the application of gold in the electronics industry, and in the decorative gold-plating of spectacle frame, watches, bracelets and other items.

In accordance with the present invention, one may also obtain ternary silver-copper-zinc alloys with over 80 percent by weight of silver content, which are extremely tarnish resistant. With regard to color and ducility, those alloys stand out which have 10 percent by weight of zinc and about 1 to 3 percent by weight of copper.

From the electrolyte in accordance with the present invention, one can also separate quaternary alloys, e.g., gold-silver-copper-palladium alloys which, with excellent electrical conductivity, are low in microvoltage up to a layer thickness of 8 um and have a wear resistance 50 times better than fine gold.

The bath in accordance with the present invention is also distinguished by the fact that it can be operated both with soluble anodes, such as silver or copper anodes or silver-copper anodes, and with insoluble anodes, such as platinated titanium or carbon.

Furthermore, it has the special advantage of a cyanide-free and hence relatively nontoxic mode of operation which results in improved occupational hygiene and a reduction in the expense for waste water treatment.

Because of its peculiar composition, it permits without disadvantages, an addition of cyanide-containing salts, since these are immediately transformed into less toxic rhodanides as a result of the thiosulphate content.

EXAMPLE 1

| Bath Composition: | |
|---|---|
| silver as sodium dithiosulphate argentate (I) | |
| $Na_3[Ag(S_2O_3)_2]\cdot 2\ H_2O$ | 0.04 molar = 4.3 g silver/liter |
| gold as sodium disulphite aurate (I) | |
| $Na_3[Au(SO_3)_2]$ | 0.04 molar = 7.9 g gold/liter |
| sodium thiosulphate | |
| $Na_2S_2O_3\cdot H_2O$ | 0.5 molar = 119 g/liter |
| sodium sulphite $Na_2SO_3$ | 0.05 molar = 6.3 g/liter |
| sodium tetraborate | |
| $Na_4B_4O_7\cdot H_2O$ | 0.01 molar = 4.28 g/liter |
| **Operating Conditions:** | |
| pH value: | 9.3 |
| temperature: | 23°C |
| applicable current density: | 0.1 to 2 Amp/dm² |
| electrolyte or cathode movement | |
| anode: | platinated titanium |

Result:

With the above conditions, one obtains a 14-karat gold-silver alloy of white, silverlike color. Depending on the concentration conditions of the alloying metals, coatings of about 0 to 100% silver or gold content can be deposited.

EXAMPLE 2

| Bath Composition: | |
|---|---|
| silver as silver (I) oxide | |
| $Ag_2O$ | 0.03 molar = 6.96 g silver/liter |
| palladium as palladium sulphate | |
| $PdSO_4$ | 0.12 molar - 11.0 g palladium/liter |
| glycine | |
| $NH_2—CH_2—COOH$ | 0.25 molar - 18.8 g/liter |
| sodium thiosulphate | |
| $Na_2S_2O_3$ | 1.5 molar = 237 g/liter |
| potassium sulphite | |
| $K_2SO_3$ | 0.1 molar = 16 g/liter |

-continued

| | |
|---|---|
| boric acid | |
| $H_3BO_3$ | 0.01 molar - 0.6 g/liter |
| **Operating Conditions:** | |
| pH value: | 10.2 |
| temperature: | 30°C |
| anode: | platinated titanium |

Result:

One obtains a silver-palladium alloy containing about 5 percent by weight palladium.

EXAMPLE 3

| Bath Composition: | |
|---|---|
| silver as silver sulphate | |
| $Ag_2SO_4$ | 0.08 molar = 17.3 g silver/liter |
| copper as sodium copper thiosulphate | |
| $Na_2[Cu_2(S_2O_3)_2]$ | 0.04 molar - 5.1 g copper/liter |
| sodium thiosulphate | |
| $Na_2S_2O_3\cdot 5\ H_2O$ | 0.4 molar - 95 g/liter |
| sodium sulphite | |
| $Na_2SO_3$ | 0.4 molar = 50 g/liter |
| sodium tetraborate | |
| $Na_4B_4O_7\cdot 10\ H_2O$ | 0.004 molar = 1.7 g/liter |
| **Operating Conditions:** | |
| pH value: | 9.6 |
| temperature: | 20°C |
| current density | 0.1 to 2 Amp/dm² |
| anode: | Ag-Cu alloy or platinated titanium |

Result:

One obtains a silver-copper alloy, appearing slightly darker than silver, with about 24 to 28 percent by weight copper. With different concentration ratios Ag/Cu in the bath liquid, also alloys with lower or higher silver content can be deposited.

EXAMPLE 4

| Bath Composition: | |
|---|---|
| silver as silver chloride | |
| AgCl | 0.3 molar = 32.4 g silver/liter |
| cadmium as cadmium sulphate | |
| $CdSO_4\cdot 3/8\ H_2O$ | 0.008 molar = 0.89 g cadmium/liter |
| sodium thiosulphate | |
| $Na_2S_2O_3\cdot 5\ H_2O$ | 2.0 molar = 476 g/liter |
| sodium sulphite | |
| $Na_2SO_3$ | 0.04 molar = 5.04 g/liter |
| disodium hydrogen phosphate | |
| $Na_2HPO_4$ | 0.04 = 5.6 g/liter |
| **Operating Conditions:** | |
| pH value: | 10.0 |
| anode: | silver |

Result:

One obtains a silver-cadmium alloy with about 01. to 1 percent by weight cadmium. Its tarnish resistance is much better than that of pure silver. With different bath concentrations, other silver alloys can also be deposited.

EXAMPLE 5

| Bath Composition: | |
|---|---|
| silver as sodium dithiosulphate argentate (I) | |
| $Na_3[Ag(S_2O_3)_2]\cdot 2\ H_2O$ | 0.25 molar = 26.9 g silver/liter |
| copper as copper ethylene diamine tetracetate | |
| Di-sodium salt | |

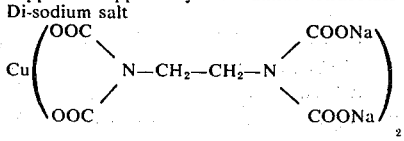

-continued

| | |
|---|---|
| | 0.15 molar = 9.50 g copper/liter |
| sodium thiosulphate $Na_2S_2O_3 \cdot 5\ H_2O$ | 0.75 molar = 186 g/liter |
| potassium sulphite $K_2SO_3$ | 0.05 molar = 7.9 g/liter |
| sodium arsenite $Na_3AsO_3$ | 0.001 molar = 0.19 g/liter |
| sodium dihydrogen phosphate $NaH_2PO_4$ | 0.05 molar = 6.0 g/liter |

Operating Conditions:

| | |
|---|---|
| pH value: | 7.2 |
| temperature: | 25°C |
| anodes: | platinated titanium |
| current density: | 0.1 to 2 Amp/dm² |

Results:

From this bath one obtains a silver alloy containing about 10 to 12 percent by weight copper. It is silver-colored and shiny (like sterling silver). If one selects another ratio for the bath concentrations of silver or copper, other alloys may also be separated.

EXAMPLE 6

Bath Composition:

| | |
|---|---|
| gold as sodium heptathiosulphate di-aurate (I) $Na_{12}[Au_2(S_2O_3)_7] \cdot 10\ H_2O$ | 0.03 molar - 11.8 g gold/liter |
| copper as sodium copper thiosulphate $Na_2Cu_2(S_2O_3)_2$ | 0.3 molar = 38.1 g copper/liter |
| sodium thiosulphate $Na_2S_2O_3 \cdot 5\ H_2O$ | 1.2 molar - 297.8 g/liter |
| sodium sulphite $Na_2SO_3$ | 0.3 molar = 37.8 g/liter |
| boric acid $B(OH)_3$ | 0.3 molar = 18.6 g/liter |
| ethylene glycol $HO—CH_2—CH_2—OH$ | 0.6 molar = 37.2 g/liter |

Operating Conditions:

| | |
|---|---|
| pH value: | 6.8 |
| temperature | 28°C |
| anodes: | platinized titanium |
| current density: | 0.3 to 1.5 Amp/dm$_2$ |

Result:

One obtains a rose colored gold alloy of 18 carat. The composition of the alloy depends on the concentrations of the metals in the bath liquid and the current density applied. The cathodic current yield is nearly 100%.

EXAMPLE 7

Bath Composition:

| | |
|---|---|
| gold as sodium disulphite aurate $Na_3[Au(SO_3)_2]$ | 0.05 molar = 9.85 g gold/liter |
| palladium as palladium ethylene diamine tetra-acetate, disodium salt | 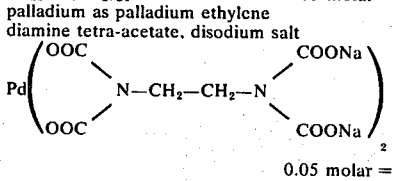 |
| | 0.05 molar = 5.37 g palladium/liter |
| ammonium thiosulphate $(NH_4)_2S_2O_3$ | 1.0 molar = 148 g/liter |
| ammonium sulphite $(NH_4)_2SO_3$ | 0.1 molar = 1.8 g/liter |
| boric acid $B(OH)_3$ | 0.3 molar = 18.6 g/liter |
| ethylene glycol $HO—CH_2—CH_2—OH$ | 0.6 molar - 37.2 g/liter |

Operating Conditions:

| | |
|---|---|
| pH value: | 6.4 |
| temperature: | 22°C |
| anodes: | rhodinated titanium |

Operating Conditions:

Result:

From this electrolyte, in accordance with the present invention, one obtains a gold alloy with about 5 percent by weight palladium. The coating has the color of rolled gold and is extremely ductile even with layer thicknesses above 10 um.

EXAMPLE 8

Bath Composition:

| | |
|---|---|
| gold as sodium disulphite aurate (I) $Na_3[Au(SO_3)_2]$ | 0.03 molar = 5.9 g gold/liter |
| silver as sodium dithiosulphate rgentate (I) $Na_3[Ag(S_2O_3)_2] \cdot 2\ H_2O$ | 0.05 molar = 5.39 g silver/liter |
| cadmium as cadmium thiosulphate $CdS_2O_3$ | 0.1 molar = 11.2 g cadmium/liter |
| sodium thiosulphate $Na_2S_2O_3 \cdot 5\ H_2O$ | 1.5 molar = 372.3 g/liter |
| potassium sulphite $K_2SO_3$ | 0.15 molar = 23.7 g/liter |
| sodium tetraborate $Na_4B_4O_7 \cdot 10\ H_2O$ | 0.02 molar = 8.6 g/liter |

Operating Conditions:

| | |
|---|---|
| pH value | 10.0 |
| temperature: | 45°C |
| anodes: | platinated titanium |

Result:

From this electrolyte one obtains an alloy containing about 48 percent by weight cadmium, 30 percent by weight silver and 15 percent by weight gold. The coating is dark-colored and shiny. By reducing the cadmium content in the bath and increasing the silver concentration, one obtains bright lustrous deposits.

EXAMLE 9

Bath Composition:

| | |
|---|---|
| silver as sodium dithiosulphate argentate (I) $Na_3[Ag(S_2O_3)_2] \cdot 2\ H_2O$ | 0.05 molar = 5.4 g silver/liter |
| gold as sodium dithiosulphate aurate (I) $Na_3[Au(S_2O_3)_2] \cdot 2\ H_2O$ | 0.06 molar = 11.8 gold/liter |
| copper as sodium copper thiosulphate $Na_3Cu(S_2O_3)_2$ | 0.3 molar = 19.0 g copper/liter |
| sodium thiosulphate $Na_2S_2O_3$ | 0.5 molar – 79.1 g/liter |
| sodium sulphite $Na_2SO_3$ | 0.25 molar – 31.5 g/liter |
| sodium tetraborate $Na_4B_4O_7 \cdot 10\ H_2O$ | 0.03 molar – 12.8 g/liter |

Operating Conditions:

| | |
|---|---|
| pH value: | 9.2 |
| temperature: | 19°C |
| anodes: | platinated titanium |

Result:

One obtains a 14-karat alloy containing about 5 percent by weight copper. Its electrical conductivity is 28 m/ohm mm².

EXAMPLE 10

Bath Composition:

| | |
|---|---|
| copper as sodium copper thiosulphate $Na_2Cu(S_2O_3)_2$ | 0.15 molar=19 g copper/liter |
| gold as sodium disulphite aurate (I) $Na_3[Au(SO_3)_2]$ | 0.03 molar =5.9 g gold/liter |
| cadmium as cadmium thiosulphate | |

-continued

| | |
|---|---|
| $CdS_2O_3$ | 0.05 molar=1.7 g cadmium/liter |
| sodium thiosulphate $Na_2S_2O_3$ | 0.3 molar=47.4 g/liter |
| potassium thiosulphate $K_2S_2O_3$ | 0.2 molar=38.0 g/liter |
| sodium sulphite $Na_2SO_3$ | 0.05 molar=6.3 g/liter |
| potassium metabisulphite $K_2S_2O_5$ | 0.01 molar=2.2 g/liter |
| boric acid $H_3BO_3$ | 0.15 molar=18.6 g/liter |
| Operating Conditions: | |
| pH value: | 6.5 |
| temperature: | 23°C |
| anodes: | platinated titanium |

Result:

One obtains a 18-karat gold alloy with about 1 to 3 percent by weight cadmium. It is rose colored, tarnish-free and of excellent ductility. Its elongation at rupture is 3.8%.

EXAMPLE 11

| | |
|---|---|
| Bath Composition: | |
| silver as sodium dithiosulphate argentate (I) $Na_3[Ag(S_2O_3)_2].2H_2O$ | 0.3 molar=33.4 g silver/liter |
| copper as sodium copper thiosulphate $Na_2[Cu_2(S_2O_3)_2]$ | 0.3 molar=38.1 g copper/liter |
| cadmium as sodium dithiosulphate cadmiate $Na_2[Cd(S_2O_3)_2]$ | 0.03 molar=3.4 g cadmium/liter |
| sodium thiosulphate $Na_2S_2O_3.5H_2O$ | 1.5 molar=372.3 g/liter |
| sodium sulphite $Na_2SO_3$ | 0.05 molar=6.3 g/liter |
| sodium tetraborate $Na_4B_4O_7.10H_2O$ | 0.02 molar=8.6 g/liter |
| Operating Conditions: | |
| pH value: | 10.1 |
| temperature: | 24°C |
| anodes: | Ag/Cu or platinated titanium |
| current density: | 0.1 to 2.5 Amp/dm² |

Result:

One obtains a silver alloys with about 5 percent by weight copper and 2 percent by weight cadmium. It is silver colored and lustrous. When testing for tarnish resistance with liver of sulphur, it withstands attack 10 times longer than pure silver.

EXAMPLE 12

| | |
|---|---|
| Bath Composition: | |
| silver as silver (I) oxide $Ag_2O$ | 0.015 molar=3.23 g silver/liter |
| gold as sodium heptathiosulphate diaurate (I) $Na_{12}[Au(S_2O_3)_7].10H_2O$ | 0.07 molar=27.6 g gold/liter |
| palladium as taurine complex $Pd(NH_2—CH_2—SO_3)_2SO_4$ | 0.08 molar=8.5 g palladium/liter |
| copper as sodium copper thiosulphate $Na_2[Cu_2(S_2O_3)_2]$ | 0.08 molar=10.1 g copper/liter |
| sodium thiosulphate $Na_2S_2O_3$ | 2.0 molar=316.4 g/liter |
| sodium sulphite $Na_2SO_3$ | 0.25 molar=31.5 g/liter |
| potassium metabisulphite $K_2S_2O_5$ | 0.2 molar=44.4 g/liter |
| potassium dihydrogen phosphate $KH_2PO_4$ | 0.02 molar=2.72 g/liter |
| taurine, Na salt $H_2N—CH_2—SO_3Na$ | 0.2 molar=26.2 g/liter |
| Operating Conditions: | |
| pH value: | 6.9 |
| temperature: | 16°C |
| anodes: | carbon or rhodianted titanium |

-continued

| | |
|---|---|
| current density | 0.1 to 1.2 Amp/dm² |

Mode of Operation and Result:

One dissolves the thiosulphate in about half the required quantity of water (about 0.5 liter), then one adds simultaneously sulphite, silver oxide and bisulphite. As soon as everything is dissolved, one adds the solution of palladium sulphate in taurine ($NH_2$-$CH_2$-$SO_3H$) and dissolves the remaining bath components. If the solution is slightly turbid, one filters with about 1g of active charcoal, adjusts the pH value with NaOH and fills up to 1 liter of bath liquid. From the electrolyte according to the present invention, one can deposit a 16-karat gold alloy with about 5 percent by weight palladium and 5 percent by weight copper. It has a hardness of 250 to 300 Vickers ($HV_{010}$) and is particularly well suited for improving contacts, since it is extremely wear resistant.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

We claim:

1. A cyanide-free aqueous bath comprising as its essential components at least 1g/liter of an alkali thiosulfate and at least 2 electrodepositable metals in the form of compounds selected from the group consisting of trisodium dithiosulfate argentate, tetrasodium trithiosulfate argentate, trisodium dithiosulfate aurate, tetrasodium trithiosulfate aurate, dodecasodium heptathiosulfate diaurate, dipotassium dithiosulfate palladate and tetrasodium trithiosulfate palladate, the concentration of said metal compounds being from about 0.01 to about 70 g/liter, said bath having a pH value between about 4 and about 13.

2. The bath as defined in claim 1 which further contains at least one of the alloying metals selected from the group consisting of copper, nickel, cobalt, manganese, zinc, cadmium, indium, tin, lead, antimony and arsenic, said alloying metals being present in the form of water soluble compounds and in a concentration of about 0.001 g to about 100 g per liter.

3. A process for the electrodeposition of a precious metal alloy which comprises passing a current through the bath of claim 2 at a current density between about 0.1 and about 5 amperes per dm² at a temperature between about 10° and about 80°C.

4. The bath as defined in claim 1 wherein the bath includes soluble anodes.

5. The bath as defined in claim 1, wherein said thiosulphate is present in concentrations of from 20 g/liter to 500 g/liter.

6. The bath as defined in claim 1, wherein the bath has a pH value of from 5 to 11.

7. The bath as defined in claim 1 which includes insoluble anodes.

8. A process for the electrodeposition of a precious metal alloy which comprises passing a current through the bath of claim 1 at a current density between about 0.1 and about 5 amperes per dm² at a temperature between about 10° and about 80°C.

9. The bath as defined in claim 1 wherein said alkali thiosulfate is selected from the group consisting of ammonium thiosulfate, sodium thiosulfate, and potassium thiosulfate.

* * * * *